US010857052B1

(12) United States Patent
Grismer

(10) Patent No.: US 10,857,052 B1
(45) Date of Patent: Dec. 8, 2020

(54) TREATMENT TABLE FOR THERAPEUTIC TREATMENT, PHYSICAL REHABILITATION AND TRAINING AND METHOD OF USE

(71) Applicant: Pivotal Health Solutions, Inc, Watertown, SD (US)

(72) Inventor: Quentin Grismer, Watertown, SD (US)

(73) Assignee: Pivotal Health Solutions, Inc., Watertown, SD (US)

( * ) Notice: Subject to any disclaimer, the term of this patent is extended or adjusted under 35 U.S.C. 154(b) by 0 days.

(21) Appl. No.: 15/252,387

(22) Filed: Aug. 31, 2016

(51) Int. Cl.
*A61G 13/10* (2006.01)
*A61G 13/08* (2006.01)
*A61G 13/00* (2006.01)

(52) U.S. Cl.
CPC ..... *A61G 13/009* (2013.01); *A61G 13/00* (2013.01); *A61G 13/08* (2013.01); *A61G 13/105* (2013.01)

(58) Field of Classification Search
CPC .... A61G 13/009; A61G 13/08; A61G 13/105; A61G 7/005; A61G 7/008; A61G 7/012; A61G 7/015; A61G 15/02; A61G 15/007
See application file for complete search history.

(56) References Cited

U.S. PATENT DOCUMENTS 395,001 A * 12/1888 Russell ..... A61G 7/015 5/619
1,775,547 A 9/1930 Bayer
3,060,926 A * 10/1962 James ..... A61H 1/02 601/35
4,103,170 A * 7/1978 Spradlin ..... A61G 1/00 378/174
4,552,346 A * 11/1985 Schnelle ..... A61G 13/0036 378/209
4,865,303 A * 9/1989 Hall ..... A61G 13/04 5/614
5,479,666 A * 1/1996 Foster ..... A61G 7/002 297/423.3
5,922,011 A 7/1999 Cuccia
6,202,230 B1 * 3/2001 Borders ..... A61G 13/0009 5/613
6,272,702 B1 * 8/2001 Uchida ..... A61G 5/006 5/600
6,516,479 B1 2/2003 Barbour
6,692,451 B2 2/2004 Splane
7,341,565 B2 3/2008 Splane
7,454,806 B2 * 11/2008 Koch ..... A61G 13/1245 5/618
7,540,877 B2 6/2009 Emsky
(Continued)

OTHER PUBLICATIONS

Office Action dated Oct. 11, 2019; U.S. Appl. No. 13/970,799.

*Primary Examiner* — Robert G Santos
*Assistant Examiner* — Rahib T Zaman
(74) *Attorney, Agent, or Firm* — Jeffrey A. Proehl; Woods, Fuller, Shultz & Smith, PC

(57) ABSTRACT

A Treatment Table for Therapeutic Treatment, Physical Rehabilitation and Training and Method of Use for providing optimal anatomical patient positioning and range of motion to support a wide range of activities using a single stable platform. The Treatment Table includes adjustable thigh and calf support members, adjustable back support, and adjustable height for optimal positioning of the patient for the desired treatment or activity.

20 Claims, 5 Drawing Sheets

(56) References Cited

U.S. PATENT DOCUMENTS 7,657,953 B2 * 2/2010 Reckelhoff ..... A61G 7/05 5/602
7,685,659 B2 * 3/2010 Heimbrock ..... A61G 13/0009 5/602
8,495,774 B2 * 7/2013 Soltani ..... A61G 7/053 5/178
8,615,827 B2 * 12/2013 Newkirk ..... A61G 7/015 297/423.19
8,651,569 B2 * 2/2014 Andoloro ..... A47C 1/026 297/195.11
9,009,896 B2 4/2015 Suh
RE46,032 E * 6/2016 Torrie ..... A61H 1/0218
2002/0083527 A1 * 7/2002 Ruehl ..... A61G 7/05 5/600
2003/0135137 A1 * 7/2003 Splane, Jr. ..... A61G 13/009 601/24
2003/0172462 A1 9/2003 Hoggatt
2004/0133979 A1 * 7/2004 Newkirk ..... A61G 13/0036 5/600
2005/0028281 A1 * 2/2005 Ooyama ..... A61G 7/015 5/618
2006/0026762 A1 2/2006 Hornbach
2007/0277317 A1 12/2007 Ferko
2011/0219545 A1 * 9/2011 Dorenbeck ..... A61G 7/015 5/611
2013/0086747 A1 * 4/2013 Gharieni ..... A61G 13/009 5/622
2013/0111667 A1 5/2013 Stern
2013/0206149 A1 * 8/2013 Spendley ..... A61G 13/08 128/845
2014/0304917 A1 * 10/2014 Ruch ..... H02P 8/00 5/616
2015/0320625 A1 * 11/2015 White ..... A61G 15/02 297/344.12
2016/0106611 A1 * 4/2016 Clayton ..... A61G 13/02 5/616

* cited by examiner

TREATMENT TABLE FOR THERAPEUTIC TREATMENT, PHYSICAL REHABILITATION AND TRAINING AND METHOD OF USE

BACKGROUND OF THE INVENTION

Field of the Invention

The present invention relates to physical therapy tables and more particularly pertains to a new treatment table for therapeutic treatment, physical rehabilitation and training and method of use for providing optimal anatomical patient positioning and range of motion to support a wide range of activities from a single stable platform.

Description of the Prior Art

The use of physical therapy tables is known in the prior art. More specifically, physical therapy tables heretofore devised and utilized are known to consist basically of familiar, expected and obvious structural configurations, notwithstanding the myriad of designs encompassed by the crowded prior art which have been developed for the fulfillment of countless objectives and requirements.

Illustrative examples of the prior art include U.S. Pat. Nos. 5,922,011; 6,692,451; 7,341,565; 7,540,887, and United States Patent Application Publication Number US 2013/0111667.

In these respects, the treatment table for therapeutic treatment, physical rehabilitation and training and method of use according to the present invention substantially departs from the conventional concepts and designs of the prior art, and in so doing provides an apparatus primarily developed for the purpose of providing optimal anatomical patient positioning and range of motion to support a wide range of activities using a single stable platform.

SUMMARY OF THE INVENTION

In view of the foregoing disadvantages inherent in the known types of physical therapy tables now present in the prior art, the present invention provides a new treatment table for therapeutic treatment, physical rehabilitation and training and method of use construction wherein the same can be utilized for providing optimal anatomical patient positioning and range of motion to support a wide range of activities using a single stable platform.

To attain this, the present invention generally comprises a stable base assembly and a configurable platform assembly, the platform assembly preferably includes thigh and calf support members which may be individually positioned to provide optimal support and patient positioning.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is it configurability to optimally position and support the patient for both leg and shoulder range of motion exercises.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
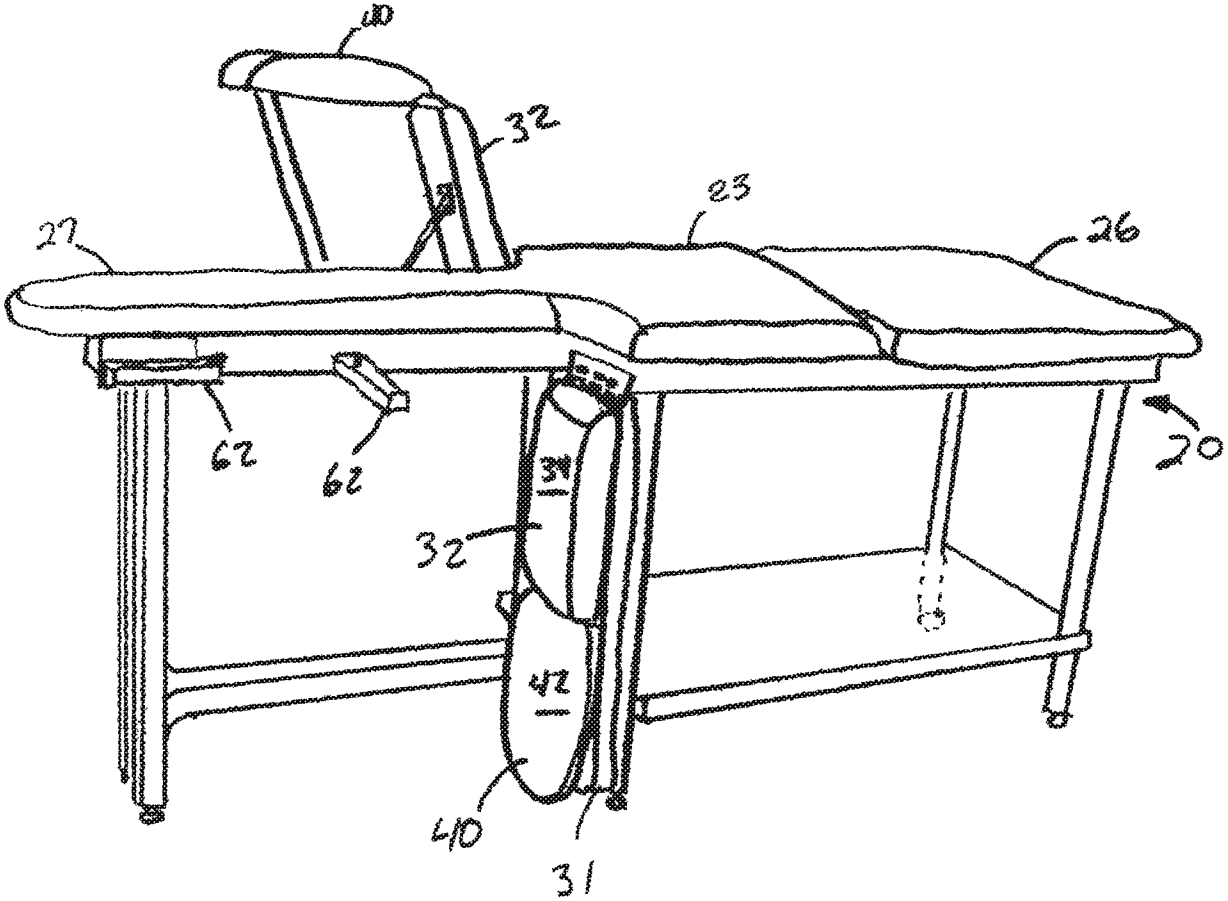
FIG. 1 is a schematic isometric view of a new treatment table for therapeutic treatment, physical rehabilitation and training and method of use according to the present invention

With reference now to the drawings, and in particular to FIGS. 1 through 4 thereof, a new treatment table for therapeutic treatment, physical rehabilitation and training and method of use embodying the principles and concepts of the present invention and generally designated by the reference numeral 10 will be described.

As best illustrated in FIGS. 1 through 4, the treatment table for therapeutic treatment, physical rehabilitation and training and method of use generally comprises a base assembly 60 designed to rest upon a floor and a platform assembly 20 operationally coupled to the base assembly 60. The platform assembly 20 is designed to support a human body.

In an embodiment the platform assembly 20 comprises a main portion 22 and a pair of limb or leg support assemblies 30. The main portion 22 is designed for supporting a torso of a human body. Each one of the leg support assemblies 30 is designed for supporting a human limb, such as a leg. Each one of the leg support assemblies 30 is operationally coupled to the main portion 22, and is independently pivotally movable referenced to the main portion 22. Preferably, each one of the at least one leg support assemblies 30 is pivotally movable downwardly between 1 degree and 90 degrees inclusive.

In a further embodiment each one of the one leg support assemblies 30 further comprises: a leg platform 31, a thigh support member 32. a calf support member 40 and a multi-position slide support 50. The leg platform 31 is typically operationally coupled to the main portion 32. This may be done by a hinge or other suitable method. The thigh support member 32 is preferably operationally coupled to the leg platform 31, typically by a hinge. Similarly, the calf support member 40 is also operationally coupled to the thigh support member 32. The multi-position slide support 50 is operationally coupled between a bottom surface 41 of the calf support member 40 and the leg platform 31.

In a still further embodiment the base assembly 60 further comprises a pair of distal leg platform support members 62 with one being positioned adjacent to a first end 61 of the base assembly 60 and the second being positioned adjacent to a central portion of the leg support assembly 30. Each of the one distal leg platform supports 62 provide vertical support for the leg platform 31 distal from where the leg support assembly 30 is operationally coupled to the main portion 22 of the platform assembly 20.

In a further embodiment the leg platform 31 provides support for a human limb, such as a leg, particularly when abutting the distal leg platform support member 62.

In a preferred embodiment the multi-position slide support 50 further comprises a first 52, second 55, and third extent 57. The first extent 52 may include a platform mounting portion 51 for coupling the first extent 52 to the leg platform 30 and a longitudinal member 70 may be pivotally coupled to the platform mounting portion 51. The second extent 55 is preferably coupled to the first extent 52, and may include a plurality of position stops 56 for providing vertical support in multiple positions. The third extent 57 preferably slideably couples to the second extent 55 to adjust an overall length of the multi-position slide support 50 and thereby adjust a position of the calf support member 40 relative to the leg platform 31. The third extent 57 may include at least one slide engagement member 59 for selectively engaging at least one of the plurality of position stops 56 of the second extent 55. The third extent 57 may also include a calf support mounting portion 58 for operationally coupling to the calf support member 40 near a distal end 44 of the calf support member 40.

In a further preferred embodiment the first extent 52 of the multi-position slide 50 further includes a mounting bolt clearance portion 53 to prevent interference between a mounting bolt used in conjunction with the platform mounting portion 51 and a hinge clearance portion 54 to prevent interference between a hinge used to pivotally couple a distal end 38 of the thigh support member 32 to a proximal end 45 of the calf support member 40.

In a still further preferred embodiment a bottom surface 41 of the calf support member 30 includes a slide member clearance cavity 43 to prevent interference between the bottom surface 41 of the calf support member 40 and the multi-position slide 50. Similarly, the bottom surface 33 of the thigh support member 31 includes a slide member clearance cavity 35 to prevent interference between the bottom surface 33 of the thigh support member 30 and the multi-position slide 50.

In yet a further embodiment the thigh support member 32 includes a top surface 34 for abutting and supporting a portion of a limb of a user, such as, for example, a thigh of a user. The thigh support member 32 is pivotally moveable between 0 and 90 degrees inclusive referenced to the reference horizontal plane of the leg platform 31 with the distal end 38 of the thigh support member 32 moving in an arc upwardly from the leg platform 31.

Similarly, the calf support member 40 includes a top surface 42 for abutting and supporting a portion of a limb of a user, such as, for example, a calf of a user. The calf support member 40 is pivotally moveable between 0 and 90 degrees inclusive referenced to the plane defined by the top surface 34 of the thigh support member 32 with the distal end 44 of the calf support member 42 moving in an arc downwardly towards a bottom surface 33 of the thigh support member 32. Preferably, the calf support member 40 moves in an arc downwardly towards the bottom surface 33 of the thigh support member 32 in fixed increments between 3 and 15 degrees inclusive.

Figure 2:
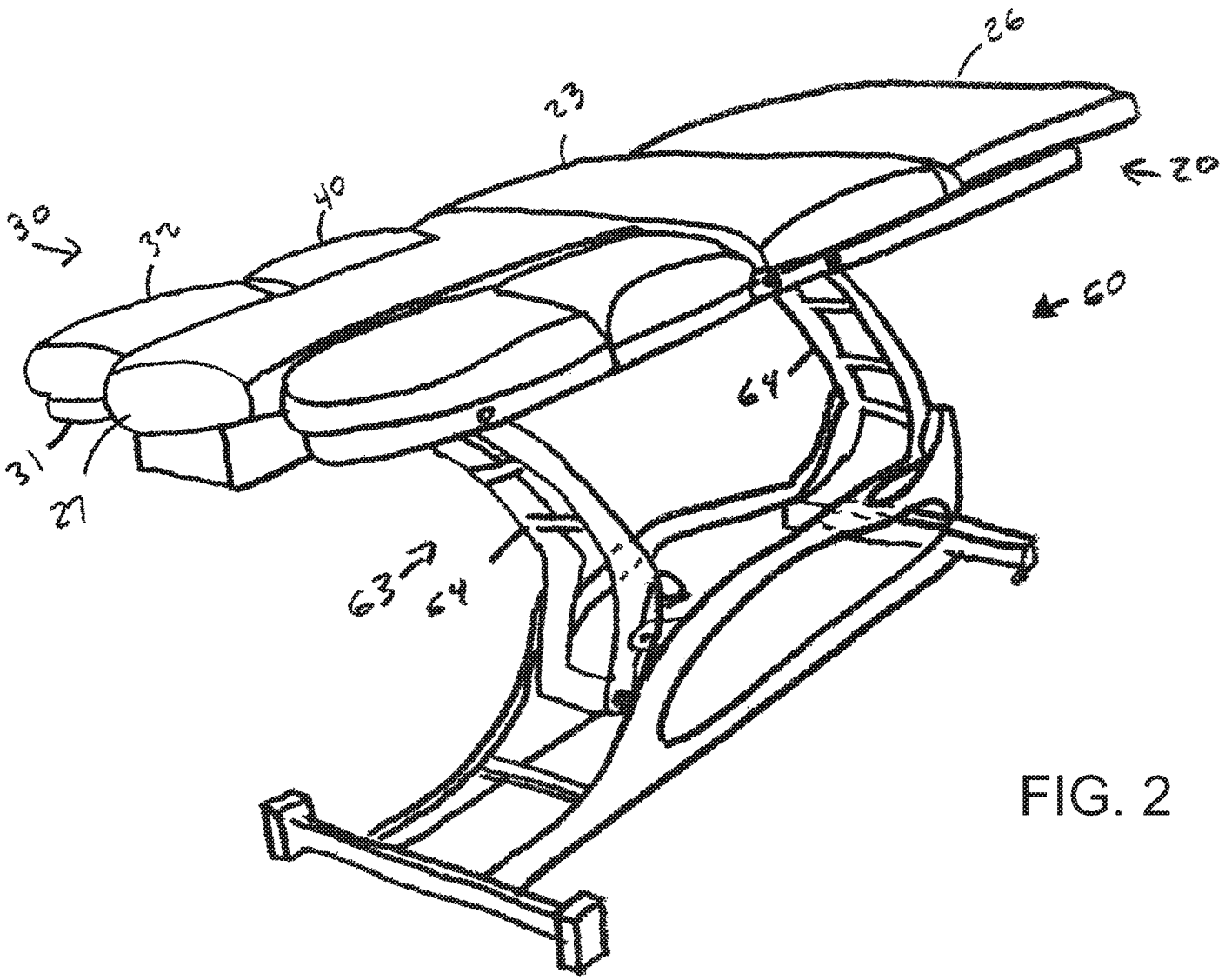
FIG. 2 is a schematic isometric view of an embodiment of the present invention.
Figure 3:
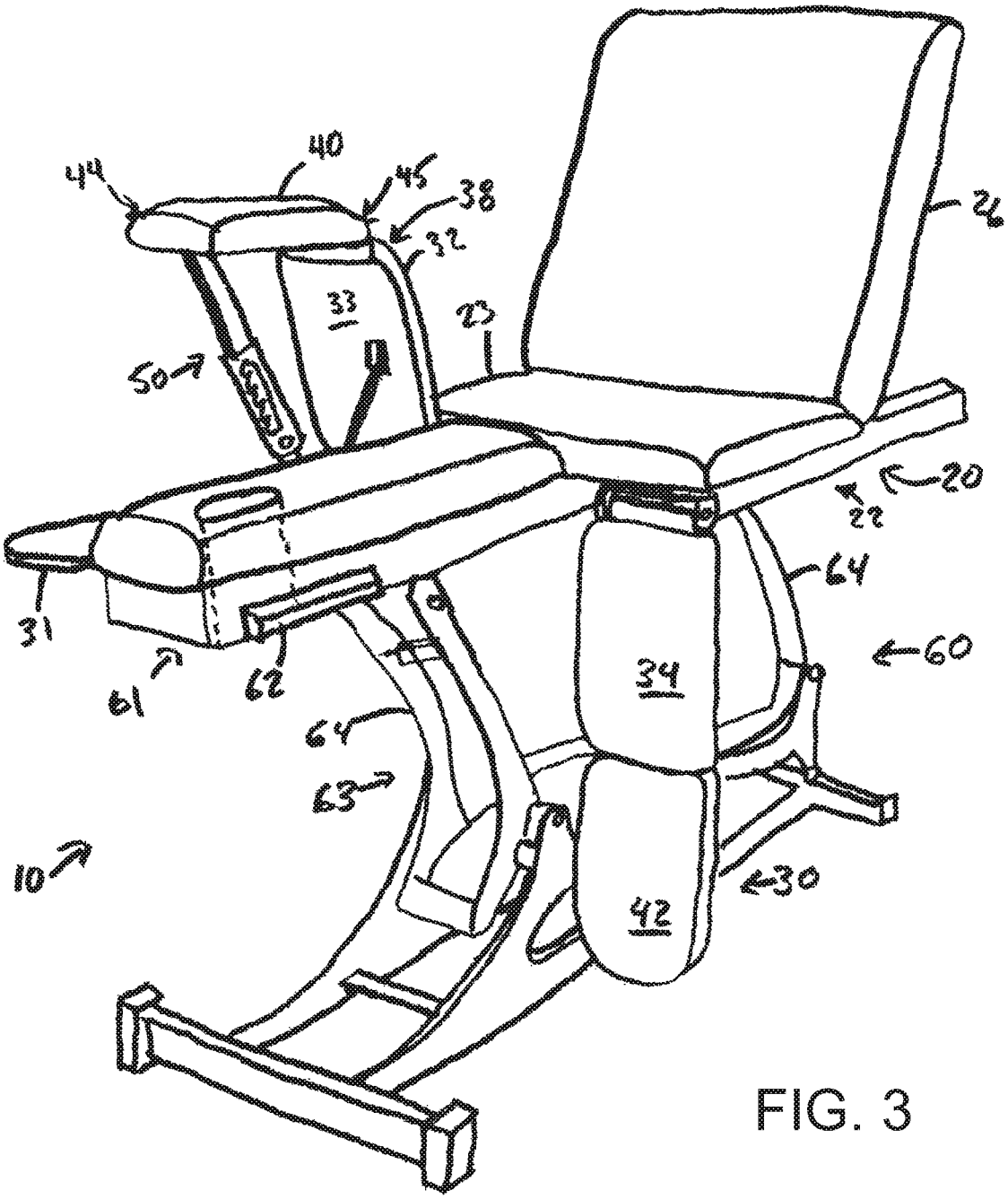
FIG. 3 is a schematic isometric view of an embodiment of the present invention.
Figure 4:
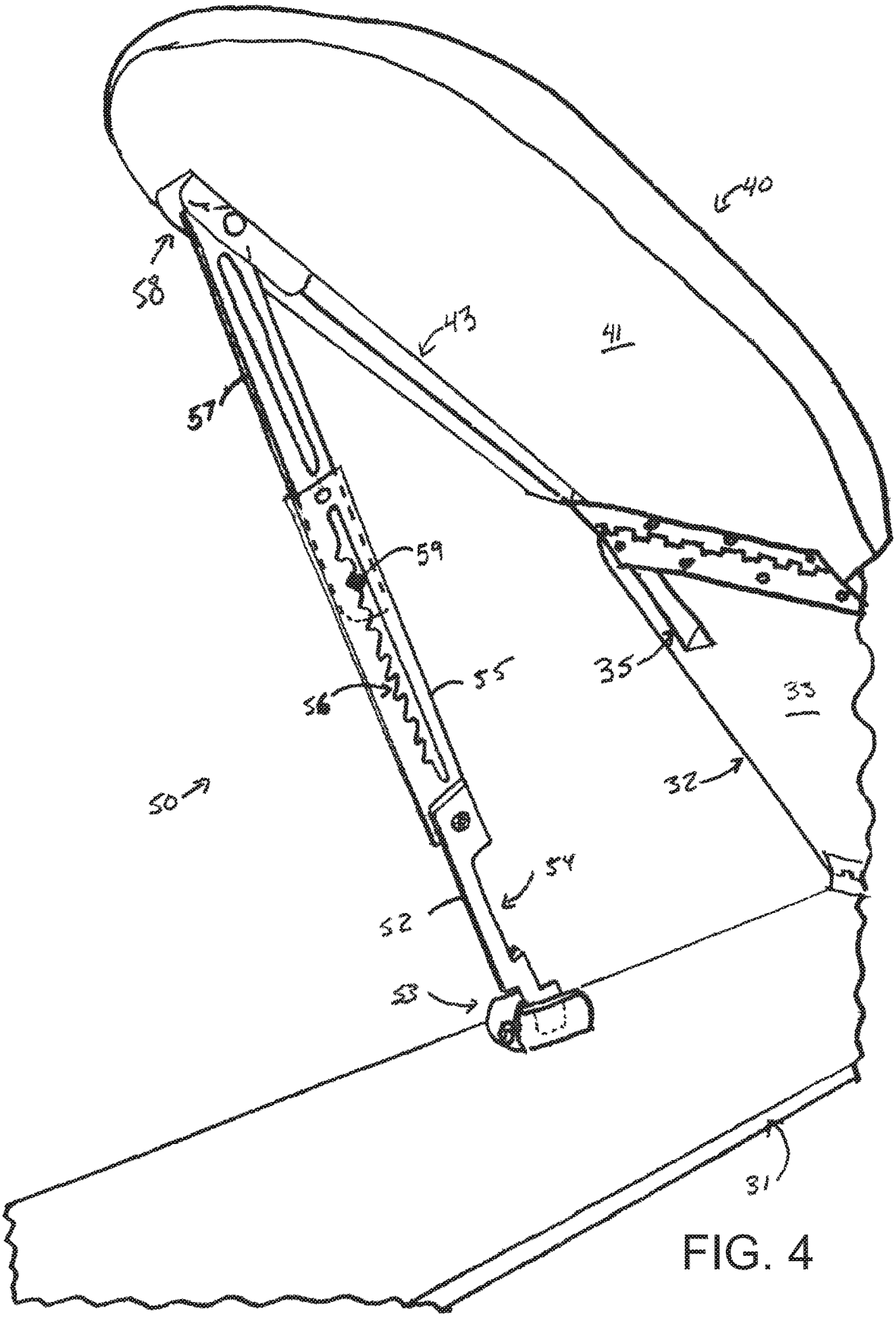
FIG. 4 is a schematic isometric view of the multi-position slide support of the present invention.
Figure 5:
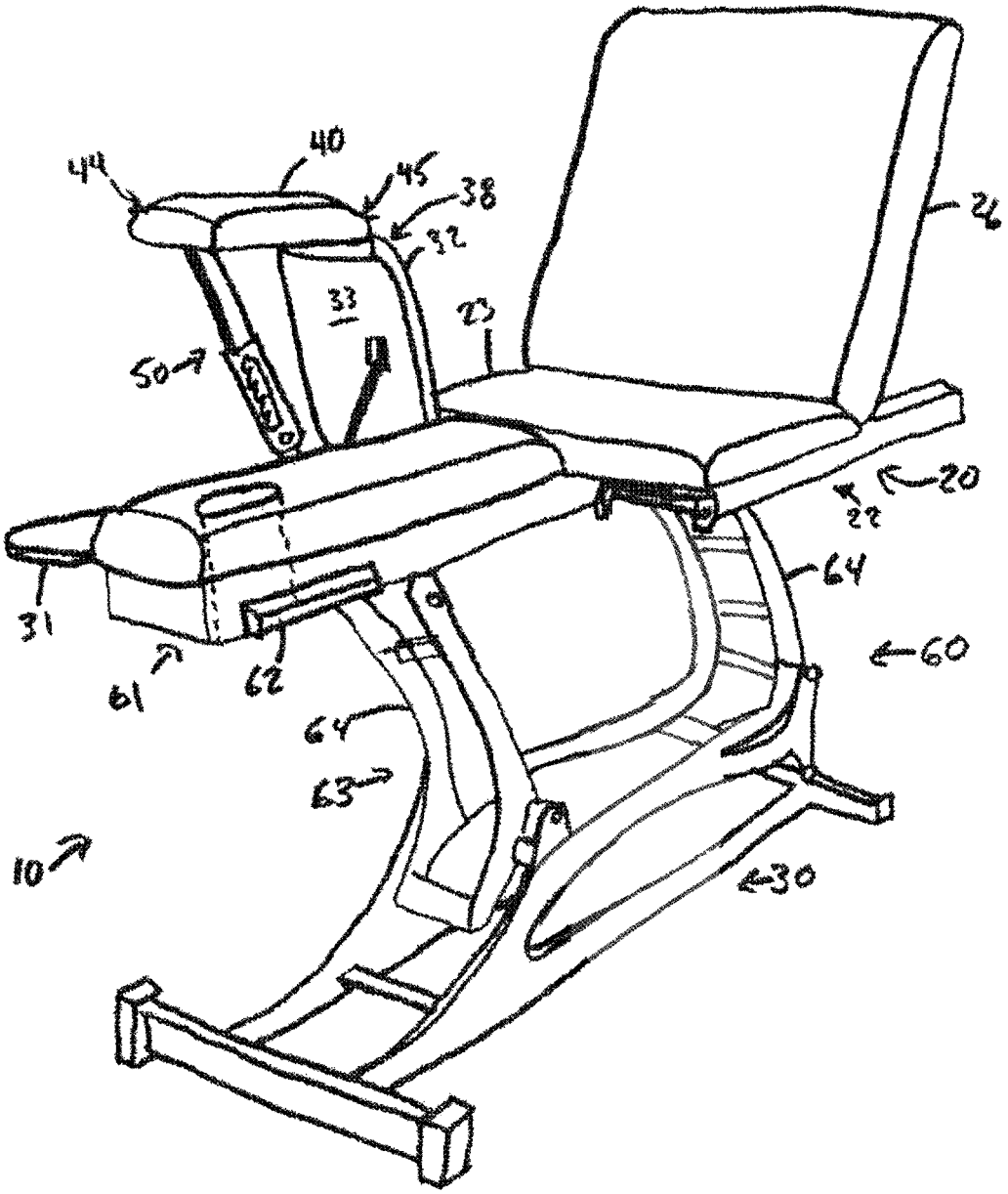
FIG. 5 is a schematic isometric view of an embodiment of the present invention.

In a still further preferred embodiment the base assembly 60 includes a height adjustment assembly 63. Thus, a height of the platform assembly 20 is adjustable between 18 and 40 inches inclusive above the floor. As shown in FIGS. 2 and 3, this is preferably accomplished through the use of pivotable sections 64 which move the platform assembly 20 forwards and backwards as well as up and down. This adjustment may be performed with the assistance of an electric motor coupled to at least one of the pivotable sections, through the use of a hydraulic ram, or other suitable method.

In a still further preferred embodiment, the main portion 22 of the platform assembly 20 further comprises a main section 23, a back section 26, and an extension section 27. The main section 23 is designed for supporting the waist and pelvic areas of a user. The back section 26 is preferably operationally coupled to a first end 24 of the main section 23 and designed for supporting the back of a user when the user is in a first orientation on the platform assembly 20 or the legs of the user when the user is in a second orientation on the platform assembly 20. The extension section 27 is typically operationally coupled to a second end 25 of the main section 23 and designed for supporting the chest and head of the user when the user is in a second orientation on the platform assembly 20 such that the arms of the user are located on either side of the extension section over the support assemblies 30.

In a still further preferred embodiment the back section 26 may be selectively pivotally moved upwardly relative to the main section 23 such that a head and back of the user may be elevated relative to the main section 23 when the user is positioned in the first orientation.

In a still further preferred embodiment the back section 26 may be selectively pivotally moved upwardly between 0 and 80 degrees inclusive referenced to the main section 23.

In at least one preferred embodiment, the extension section is positioned between the pair of leg support assemblies and is designed for supporting the chest and head of the user when the user is in a second orientation with the arms of the user are supported on the support assemblies 30.

In a still further preferred embodiment the back section may be selectively pivotally moved upwardly relative to the main section such that a head and back of the user may be elevated relative to the main section when the user is positioned in a first orientation.

In at least one embodiment, such as is shown in FIG. 3 of the drawings, the extension section 27 further includes an aperture 28 positioned adjacent to a distal end of the extension section 27 for providing clearance for a nose and mouth of a user when the user is positioned in a second orientation.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index of Elements for Treatment Table for Therapeutic Treatment, Physical Rehabilitation and Training

- ☐
- ☐
- ☐
- ☐
- ☐
- ☐
- ☐
- ☐
- ☐
- ☐
- ☐ 10. Treatment Table for Therapeutic Treatment, Physical Rehabilitation and Training
- ☐ 11.
- ☐ 12.
- ☐ 13.
- ☐ 14.
- ☐ 15.
- ☐ 16.
- ☐ 17.
- ☐ 18.
- ☐ 19.
- ☐ 20. Platform Assembly
- ☐ 21.
- ☐ 22. Main Portion
- ☐ 23. Main Section
- ☐ 24. First End
- ☐ 25. Second End
- ☐ 26. Back Section
- ☐ 27. Extension Section
- ☐ 28.
- ☐ 29.
- ☐ 30. Leg Support Assembly
- ☐ 31. Leg Platform
- ☐ 32. Thigh Support Member
- ☐ 33. Bottom Surface
- ☐ 34. Top Surface
- ☐ 35. Slide Member Clearance Cavity
- ☐ 36.
- ☐ 37.
- ☐ 38. Distal End
- ☐ 39.
- ☐ 40. Calf Support Member
- ☐ 41. Bottom Surface
- ☐ 42. Top Surface
- ☐ 43. Slide Member Clearance Cavity
- ☐ 44. Distal End
- ☐ 45. Proximal End
- ☐ 46.
- ☐ 47.
- ☐ 48.
- ☐ 49.
- ☐ 50. Multi-position Slide Support
- ☐ 51. Platform Mounting Portion
- ☐ 52. First Extent
- ☐ 53. Mounting Bolt Clearance Portion
- ☐ 54. Hinge Clearance Portion
- ☐ 55. Second Extent
- ☐ 56. Position Stops
- ☐ 57. Third Extent
- ☐ 58. Calf Support Mounting Portion
- ☐ 59. Slide Engagement Member
- ☐ 60. Base Assembly
- ☐ 61. First End
- ☐ 62. Distal Leg Platform Support Member
- ☐ 63. Height Adjustment Assembly
- ☐ 64. Pivotable Section
- ☐ 65.
- ☐ 66.
- ☐ 67.
- ☐ 68.
- ☐ 69.
- ☐ 70. Longitudinal Member.
- ☐ 71.
- ☐ 72.
- ☐ 73.
- ☐ 74.
- ☐ 75.
- ☐ 76.
- ☐ 77.
- ☐ 78.
- ☐ 79.

I claim:

1. A user treatment table comprising:

a base assembly adapted to rest upon a floor; and a platform assembly operationally coupled to the base assembly, the platform assembly being adapted to support portions of a body of a user in at least first and second orientations relative to the platform assembly, the platform assembly comprising:

an elongated main portion having a first end and a second end, the main portion comprising a plurality of sections with each section having a body support surface, the plurality of sections including:

a main section located between the first and second ends of the main portion in a position configured to support a lower torso portion of the body of the user when the user is in each of the first and second orientations of the user with respect to the platform assembly;

a back section located between the main section and the first end of the main portion in a position configured to support an upper torso portion of the body of the user in the first orientation of the user with respect to the platform assembly and configured to support leg portions of the body of the user when the user is in the second orientation of the user with respect to the platform assembly;

an extension section located between the main section and the second end of the main portion in a position configured to support the upper torso portion of the body of the user when the user is in the second orientation of the user with respect to the platform assembly; and a pair of limb support assemblies each having a body support surface, the body support surfaces of the limb support assemblies being located on opposite lateral sides of the body support surface of the extension section of the main portion in positions configured to support the legs of the user when the user is in the first orientation with respect to the platform assembly;

wherein the body support surfaces of the limb support assemblies are movable with respect to the body support surface of the extension section from a first condition in which the respective body support surfaces are in a substantially planar relationship to a second condition in which the body support surfaces of the limb support assemblies are raised out of the substantially planar relationship of the first condition; and wherein the body support surfaces of the limb support assemblies are movable with respect to the body support surface of the extension section from the first condition to a third condition in which the body support surfaces of the limb support assemblies are lowered out of the substantially planar relationship of the first condition.

2. The treatment table of claim 1 wherein each of the limb support assemblies of the platform assembly comprises:

a thigh support member located adjacent to the main section of the main portion in a position configured to support a thigh of the leg portion of the body of the user; and a calf support member operationally coupled and located adjacent to the thigh support member in a position configured to support a calf of the leg portion of the body of the user.

3. The treatment table of claim 2 wherein the thigh support member is pivotable upwardly relative to the main section of the main portion of the platform assembly between an orientation in which the body support surface of the limb support assembly on the thigh support member is substantially horizontal and an orientation in which the body support surface of the thigh support member is substantially vertical.

4. The treatment table of claim 3 wherein the thigh support member is pivotable relative to the main section of the main portion of the platform assembly in a manner such that the body support surface of the thigh support member adjusts in an increment of 1 degree to 15 degrees inclusive.

5. The treatment table of claim 3 wherein the thigh support member is pivotable relative to the main section of the main portion of the platform assembly in a manner such that the body support surface of the thigh support member is continuously adjustable relative to the main section.

6. The treatment table of claim 3 wherein the calf support member is pivotable downwardly relative to the thigh support member from an orientation in which the body support surface of the limb support assembly on the calf support member is substantially coplanar with the body support surface of the thigh support member and an orientation in which the body support surface of the calf support member is at a substantially right angle relative to the body support surface of the thigh support member.

7. The treatment table of claim 6 wherein the calf support member is pivotable relative to the thigh support member in a manner such that the body support surface of the calf support member adjusts in an increment of 1 degree to 15 degrees inclusive.

8. The treatment table of claim 6 wherein the calf support member is pivotable relative to the thigh support member in a manner such that the body support surface of the calf support member is continuously adjustable relative to the thigh support member.

9. The treatment table of claim 2 wherein the base assembly is adjustable to selectively adjust a height of the body support surface of the main portion of the platform assembly relative to the floor.

10. The treatment table of claim 2 wherein the calf support member of at least one of the limb support assemblies is distally supported by an extension support.

11. The treatment table of claim 1 wherein each one the pair of limb support assemblies is movable relative to the base assembly independently of the other said limb support assembly.

12. The treatment table of claim 10 wherein at least one limb support assembly of the pair of limb support assemblies is pivotable downwardly with respect to the main portion to a substantially vertical orientation.

13. The treatment table of claim 10 wherein at least one of the pair of limb support assemblies is selectively removable from the main portion of the platform assembly.

14. The treatment table of claim 1, wherein the back section is selectively pivotable upwardly relative to the main section such that the upper torso portion of the body of the user is able to be elevated relative to the main section when the user is positioned in the first orientation.

15. The treatment table of claim 1 wherein the body support surface of the extension section of the main portion extends between the body support surfaces of the pair of limb support assemblies.

16. The treatment table of claim 1 wherein the platform assembly is elongated in a longitudinal direction; and wherein the body support surface of the extension section of the main portion is substantially coextensive in the longitudinal direction with the body support surfaces of the pair of limb support assemblies in the longitudinal direction.

17. A user treatment table comprising:

a base assembly adapted to rest upon a floor; and a platform assembly operationally coupled to the base assembly, the platform assembly having a body support surface with portions of the body support surface being adapted to support portions of a body of a user in at least first and second orientations relative to the platform assembly, the platform assembly comprising:

an elongated main portion having a first end and a second end, the main portion including:

a main section with a portion of the body support surface located between the first and second ends of the main portion in a position configured to support a lower torso portion of the body of the user on the portion of the body support surface of the main section when the user is in each of the first and second orientations of the user with respect to the platform assembly;

a back section with a portion of the body support surface located between the main section and the first end of the main portion in a position configured to support an upper torso portion of the body of the user on the portion of the body support surface of the back section when the user is in the first orientation of the user with respect to the platform assembly and configured to support leg portions of the body of the user in the second orientation of the user with respect to the platform assembly;

an extension section with a portion of the body support surface located between the main section and the second end of the main portion in a position configured to support the upper torso portion of the body of the user on the portion of the body support surface of the extension section when the user is in the second orientation of the user with respect to the platform assembly; and a pair of limb support assemblies each having a portion of the body support surface located on opposite lateral sides of the extension section of the main portion in positions configured to support the legs of the user when the user is in the first orientation with respect to the platform assembly, the body support surface of the extension section extending between the body support surfaces of the pair of limb support assemblies such that the body support surface of the extension section is configured to support the upper torso portion of the body of the user and the body support surfaces of the limb support assemblies are configured to support the arms of the user when the user is in the second orientation with respect to the platform assembly;

wherein the body support surfaces of the sections of the main portion of the platform assembly and the limb support assemblies are oriented upwardly;

wherein the body support surfaces of the limb support assemblies are movable with respect to the body support surface of the extension section from a first condition in which the respective body support surfaces are in a substantially planar relationship to a second condition in which the body support surfaces of the limb support assemblies are raised out of the substantially planar relationship of the first condition; and wherein the body support surfaces of the limb support assemblies are movable with respect to the body support surface of the extension section from the first condition to a third condition in which the body support surfaces of the limb support assemblies are lowered out of the substantially planar relationship of the first condition.

18. A user treatment table comprising:

a base assembly adapted to rest upon a floor; and a platform assembly operationally coupled to the base assembly, the platform assembly comprising:

an elongated main portion having a first end and a second end, the main portion comprising a plurality of sections with each section having a body support surface, the plurality of sections including:

a main section located between the first and second ends of the main portion in a position configured to support a lower torso portion of the body of the user when the user is in each of the first and second orientations of the user with respect to the platform assembly;

a back section located between the main section and the first end of the main portion in a position configured to support an upper torso portion of the body of the user in the first orientation of the user with respect to the platform assembly and configured to support leg portions of the body of the user when the user is in the second orientation of the user with respect to the platform assembly; and a pair of limb support assemblies each having a body support surface, the body support surfaces of the limb support assemblies each extending from the main section of the main portion toward the second end of the main portion in positions configured to support the legs of the user when the user is resting on the platform assembly;

wherein the body support surfaces of the limb support assemblies are movable with respect to the body support surface of the main section from a first condition in which the respective body support surfaces are in a substantially planar relationship to a second condition in which the body support surfaces of the limb support assemblies are raised out of the substantially planar relationship of the first condition; and wherein at least one of the limb support assemblies of the platform assembly comprises:

a leg platform extending from the main section of the main portion toward the second end of the main portion;

a thigh support member positioned adjacent to the main section of the main portion in a position configured to support a thigh of the leg portion of the body of the user, the thigh support member being pivotally mounted to move upwardly with respect to the leg platform to the second condition of the body support surface of the at least one limb support assembly; and a calf support member positioned adjacent to the thigh support member to support a calf of the leg portion of the body of the user, the calf support member being pivotally mounted on the thigh support member to move upwardly with the thigh support member with respect to the leg platform to the second condition of the body support surface of the at least one limb support assembly;

a first support member extending from the leg platform to the thigh support member to elevate the thigh support member above the leg platform in the second condition of the body support surface of the at least one limb support assembly;

a second support member extending from the leg platform to the calf support member to elevate the calf support member above the leg platform in the second condition of the body support surface of the at least one limb support assembly; and wherein at least one of the support members has a length which is adjustable.

19. The treatment table of claim 18 wherein the length of the second support member is adjustable to adjust a spacing between the leg platform and the calf support member in the second condition of the body support surface of the at least one limb support assembly.

20. The treatment table of claim 19 wherein the second support member includes at least two extents slidably coupled together such that sliding of the extents with respect to each other adjust the length of the second support member, one of the extents including a plurality of position stops and another one of the extents including a slide engagement member configured to selectively engage one of the position stops to set the length of the second support member.

* * * * *